United States Patent [19]

Bajohr et al.

[11] 4,331,079

[45] May 25, 1982

[54] PROCESS FOR JOINING A PLUG AND FUZE WIRES FOR ELECTRICAL DETONATORS

[75] Inventors: Walter Bajohr, Troisdorf; Hildebert Wuckel, Troisdorf-Spich, both of Fed. Rep. of Germany

[73] Assignee: Dynamit Nobel Aktiengesellschaft, Troisdorf, Fed. Rep. of Germany

[21] Appl. No.: 45,743

[22] Filed: Jun. 5, 1979

[30] Foreign Application Priority Data

Jun. 5, 1978 [DE] Fed. Rep. of Germany ..... 2824568

[51] Int. Cl.[3] ..... F42C 11/00

[52] U.S. Cl. ..... 102/202.12; 102/202.14; 86/1 R

[58] Field of Search ..... 86/1 R, 10, 12, 20, 86/22; 102/28 R, 202.9, 202.12, 202.14

[56] References Cited

U.S. PATENT DOCUMENTS

| | | | |
|---|---|---|---|
| 2,907,100 | 10/1959 | Lindblad | 86/1 R X |
| 2,924,140 | 2/1960 | Scherrer | 86/1 R X |
| 2,966,822 | 1/1961 | Kistiakowsky et al. | 86/1 R X |
| 3,615,287 | 10/1971 | Adair | 102/28 R X |
| 3,783,788 | 1/1974 | Hayashi | 102/28 R X |
| 3,978,791 | 9/1976 | Lemley et al. | 102/28 R X |
| 3,990,367 | 11/1976 | Smith | 86/1 R X |

*Primary Examiner*—Peter A. Nelson

*Attorney, Agent, or Firm*—Craig and Antonelli

[57] ABSTRACT

A process for joining a plug and fuze wires for an electrical detonator having a casing and a plug of resinous material arranged therein through which plug extend at least two fuze wires connectable at their ends within the casing to an igniter system, the process involves twisting the at least two fuze wires together to form a twisted zone at least at the ends of the wires to be received within the plug and forming the plug of resinous material around the twisted zone.

7 Claims, 2 Drawing Figures

PROCESS FOR JOINING A PLUG AND FUZE WIRES FOR ELECTRICAL DETONATORS

Figure 1:
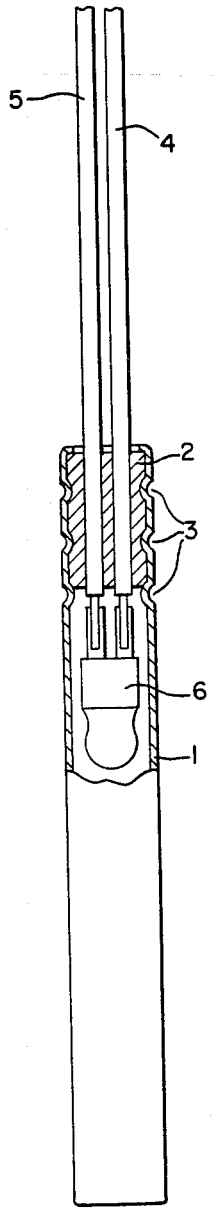

This invention relates to a process for joining fuze wires with a plug of a synthetic resin for use in electrical detonators as well as to the assembly of fuze wires with a fixedly attached plug produced thereby and the electrical detonators using this assembly.

Electrical detonating fuzes with or without installed delay means, including, for example, burning fuzes, comprising a cylindrical casing wherein an electrical igniter system, including a primer pellet, is arranged. The igniter system is connected in an electrically conductive manner with two insulated fuze wires, which are extended through a cylindrical plug. The plug is preferably produced from a thermoplastic synthetic resin; it is inserted in the casing from one end and held therein by contact with the casing wall by crimping, pressure contact, or the like fastening arrangement. By means of the plug, the fuze wires and thus also the igniter system are fixed within the casing. In case of instantaneous fuzes or delay-action fuzes, the casing is sealed or closed off at the other end; while the casing is open, for example, in case of burning fuzes to be able to introduce a blasing cap or a powder-train fuze cord.

Such electrical detonators, especially fuzes, are exposed during use to, in part, great stresses by tension or twisting at the insulated lead wires, i.e. the fuze wires, which stresses can affect, through the plug, the igniter system. In this connection, it can happen, for example, that the fuze wires are torn off from the igniter system located within the casing. In case of a primer pellet with a glow wire which is electrically connected to the fuze wires by way of two so-called laminae, the glow wire may be fractured due to displacements of the fuze wires and luminae. In both instances, current flow is interrupted during ignition, so that the electrical detonator fails. The electrical portion or assembly of the detonator comprising the two insulated fuze wires, the plug placed thereon, and the igniter system connected thereafter with the uninsulated "innercasing" ends of the fuze wires in accordance with conventional methods should, therefore, exhibit maximum mechanical strength.

For this purpose, it is known in case of prefabricated plugs to provide the two bores for the fuze wires, before the wires are inserted with an adhesive, to provide a maximally firm bond between the insulation covering the wires and the plug. It is furthermore known to connect the plug as an injection-molded part directly with the fuze wires, by directly injection-molding the thermoplastic synthetic resin around the insulated fuze wires, which previously had been inserted in a mold. In this procedure, the fuze wires can each optionally be provided, in the plug zone of the wires, with a bend for a shape-mating bond in the longitudinal direction. The strength of this bond between the plug and the insulation of each of the fuze wires is more secure than in the adhesion method, but it was found that even when injection-molding the plug directly, the adhesion between the wire insulation and the plug does not satisfy all loads occurring under practical conditions, which loads can act, after installation of the electrical portion or assembly in the detonator casing, on the outer ends of the fuze wires. Furthermore, even if a bend is provided in each wire within the plug, the bare fuze wire can still be displaced in the wire insulation surrounding this wire, and a corresponding stress can be effected on the igniter system.

The invention is based on the problem of increasing the mechanical strength of the electrical portion of the electrical detonators, especially fuzes, to secure the igniter system, particularly the primer pellet, of the electrical detonator against mechanical stresses.

This problem has been solved according to this invention by twisting the at least two insulated fuze wires together at least in a zone which will be located within the plug and then by forming the plug around the twisted zone. By means of this manufacturing process for the electrical part or assembly, a threaded anchoring of the two fuze wires in the plug is advantageously attained, and the strength of this anchoring is about three times as high as the strength obtained according to the aforementioned injection-molding method for the mounting of the plugs. With this anchoring arrangement, movements of the fuze wires relative to the plug are reliably prevented during the stresses occurring under practical conditions, so that the tensile, torsional, or like forces effective on the free fuze wires, i.e. the wires located outside of the casing, are no longer transmitted to the igniter system located at the ends of the fuze wires installed in the casing. Moreover, this screw-like anchoring feature also ensures an extremely reliable sealing action between the fuze wires and the plug against environmental influences, such as, for example, atmospheric humidity.

The plugs are preferably manufactured from a thermoplastic synthetic resin, especially PVC. Also other resins, for example, polypropylene, polystyrene, or the like may be used. Moreover, the plug can also be made, for example, from thermosetting synthetic resins with suitable mechanical properties, e.g. phenol resin or cresol resin. Preferably, the plugs are formed and attached by the injection-molding method directly to the twisted-together fuze wires. In this method, the synthetic resin is caused to flow around the twisted wire during formation of the plug. However, the plugs can also be applied in prefabricated form, for example as two plug half shells, and can then be welded together, i.e. bonded, for instance, by means of an appropriate heat treatment. The resinous material of the plug half shells is made to flow into the helical groove between the two twisted-together fuze wires and thus ensures the anchoring arrangement according to the invention.

The two fuze wires are preferably twisted together so that, in case of the customary plug lengths, at least one of the two fuze wires is embedded in the plug with at least one twisting winding, but preferably with about two or three windings. The length of the plug ranges generally between about 1.5 to 3 times the external diameter of the casing. Too strong a twisting of the fuze wires should be avoided in view of the resulting mechanical stresses in the wires and the insulation coverings, and in view of the groove cross section existing between neighboring windings, which cross section becomes smaller with increasing twisting of the wires. In general, there are 1 to 3 turns/cm formed by the two fuze wires.

In a suitable embodiment, the provision is made that the fuze wires are twisted not only in their zone where they are surrounded by the plug, but also in the adjoining zone positioned toward the outside. The term "toward the outside" in this connection relates to the arrangement after installation of the electrical portion or assembly within the casing. The fuze wires can, on this side, have a length of up to several meters, depending on the requirements in an individual case, and thus are preferably folded into figure-eight loops and twist-tied together to form a so-called wire puppet in accordance with a conventional method. The twisted zone extended out of the plug then extends preferably up to the beginning of this wire puppet. It is advantageous to effect the twisting of the two fuze wires directly after producing the wire puppet, using the same device. The outside twist imparts additional support to the fuze wires and avoids the danger of break-off during, as well as after, the manufacture of the electrical detonator.

The invention furthermore is directed to an assembly of the fuze wires with a plug firmly attached thereto, wherein the connection is established by following the above-mentioned process.

Figure 2:
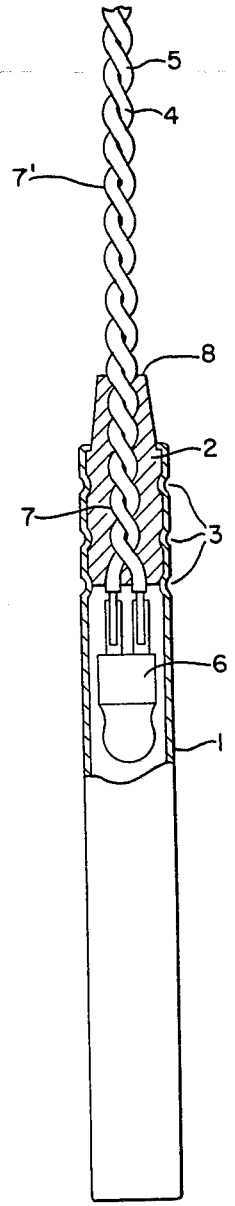

The process of this invention will be explained in greater detail with reference to an embodiment illustrated in the drawing wherein:

FIG. 1 shows an electrical fuze with a conventional connection between fuze wires and plug; and FIG. 2 shows an electrical fuze with an anchoring connection according to the invention between fuze wires and plug.

On one end of the casing 1 made, for example, of aluminum, shown in part in an elevational view in FIG. 1, the plug 2 made, for example, of PVC, is inserted, and reliably held therein by the corrugations 3. The two fuze wires 4 and 5 are extended mutually in parallel through the plug 2 and are connected in an electrically conductive fashion at their inner ends to the igniter system 6, here a primer pellet. The fuze wires 4 and 5, provided with an insulating sheath, e.g. PVC, polyethylene or polyamide, each have, for example, an outer diameter of about 1.5 mm. and the inner diameter of the casing is 6 mm. If the plug 2 is applied directly to the fuze wires 4 and 5 by the injection-molding method, these wires can be conventionally provided, in the zone of the plug 2, additionally with a curved bend, oriented for example at right angles to the plane of the drawing, to additionally obtain a certain shape-mating connection in the longitudinal direction.

As contrasted to the above procedure, in the electrical fuze shown in FIG. 2, the two fuze wires 4 and 5 are tightly twisted together to form a twisted composite 7 and the plug 2 that has been injection-molded onto the composite 7, is anchored in the manner of a nut to the twisted fuze wires 4, 5. The twisted portion of the composite 7 is extended out of the plug 2 from the end 8 facing away from the igniter system 6. This additional twisted zone 7' extends up to the puppet of the fuze wires, not shown.

We claim:

1. A process for joining a plug and fuze wires for electrical detonators, especially electrical fuzes, comprising a casing and a plug of resinous material arranged therein, through which plug extend at least two insulated fuze wires having uninsulated ends that are electrically connected on the inside of the casing to an igniter system, which comprises twisting the at least two insulated fuze wires together to form a twisted zone at least at the portions of the wires to be received within the plug, and forming a plug of resinous material around the twisted zone whereby the at least two twisted wires are anchored within the plug and forces acting on the wires located outside the casing are not transmitted to the igniter system located at the ends of the fuzed wires within said casing.

2. The process according to claim 1, wherein the plug is formed by causing at least a portion of the resinous material forming the plug to flow in a molten state around the twisted zone and by allowing the molten resinous material to solidify.

3. The process according to claim 2, wherein the plug is formed by injection molding of the resinous material around the twisted zone of the fuze wires.

4. The process according to claim 2, wherein the plug is formed from two prefabricated sections that are fitted together around the twisted zone and that are heated to cause the resinous material of each section to flow in a groove between the twisted fuze wires thereby welding the sections together and anchoring the sections to the twisted wires.

5. The process according to claim 1, wherein twisting of the two fuze wires is continued past the twisted zone within the plug at the end of the plug facing away from the igniter system.

6. The process according to claim 1, wherein the portions of the insulated fuze wires forming said twisted zone comprise about two to three windings of the wires.

7. The process according to claim 1, further comprising inserting the assembly comprised of the plug, the twisted wires and the igniter system into an open end of the casing and thereafter securing the open end of the casing to the plug.

* * * * *